US005437236A

United States Patent [19]

Zeiner

[11] Patent Number: 5,437,236

[45] Date of Patent: Aug. 1, 1995

[54] MULTI-FUNCTIONAL TABLE WITH ELEVATIONAL CAPABILITIES

[76] Inventor: Harold R. Zeiner, 7459 Passer Rd., Coopersburg, Pa. 18036

[21] Appl. No.: 323,621

[22] Filed: Oct. 17, 1994

[51] Int. Cl.[6] ..... A47B 9/10

[52] U.S. Cl. ..... 108/147; 312/231; 248/188.2; 248/188.5; 248/404; 254/93 HP; 108/3

[58] Field of Search ..... 108/147, 50, 25; 312/140.4, 231, 319.9, 351.3, 312; 248/188.2, 188.5, 157, 161, 404, 669; 254/423, DIG. 9, 93 HP

[56] References Cited

U.S. PATENT DOCUMENTS

| | | | |
|---|---|---|---|
| 2,524,085 | 10/1950 | Saul, Jr. | 108/3 X |
| 3,026,541 | 3/1962 | Murat | 254/93 HP |
| 3,311,407 | 3/1967 | Horie | 248/404 X |
| 3,514,173 | 5/1970 | Ford | 312/231 |
| 3,827,574 | 8/1974 | Craig, Sr. | 312/140.4 X |
| 3,932,009 | 1/1976 | Zollinger | 108/147 X |
| 3,967,804 | 7/1976 | Kreile | 248/188.2 |
| 4,101,005 | 7/1978 | Fewkes | 248/188.2 X |
| 4,381,714 | 5/1983 | Henneberg et al. | 248/188.5 X |
| 4,440,096 | 4/1984 | Rice et al. | 108/147 X |
| 4,637,322 | 1/1987 | Hampshire et al. | 108/147 X |
| 4,711,184 | 12/1987 | Wallin et al. | 108/147 X |
| 4,807,836 | 2/1989 | Price et al. | 108/147 X |
| 5,224,429 | 7/1993 | Borgmann et al. | 108/147 |
| 5,257,430 | 11/1993 | Yamaguchi | 243/93 HP |
| 5,259,326 | 11/1993 | Borgmann et al. | 108/147 |
| 5,271,320 | 12/1993 | Reneau | 108/147 |
| 5,289,782 | 3/1994 | Rizzi et al. | 108/147 |
| 5,313,679 | 5/1994 | Yamaguchi | 254/93 HP |
| 5,339,750 | 8/1994 | Smies | 108/147 |

*Primary Examiner*—Jose V. Chen
*Assistant Examiner*—Rodney B. White

[57] ABSTRACT

A multi-functional table with elevational capabilities comprising a base in a generally rectangular configuration having an upper surface and a parallel lower surface; a table top in a generally rectangular configuration having an upper surface and a parallel lower surface; a central cylindrical support having an upper end secured to the lower surface of the table top and having a lower end secured to the upper surface of the base, the support being formed of a tubular member of an enlarged diameter at the lower end and a tubular member of a reduced diameter at the upper end for being slidably received within the lower component; a pump including a foot pedal secured to the base adjacent to the lower component whereby reciprocation of the foot pedal will act to supply air to the space between the upper and lower components to thereby raise the upper component and the working level of the table; and a plurality of apertures formed in the table top and supplemental components adapted to be secured to the table top.

9 Claims, 7 Drawing Sheets

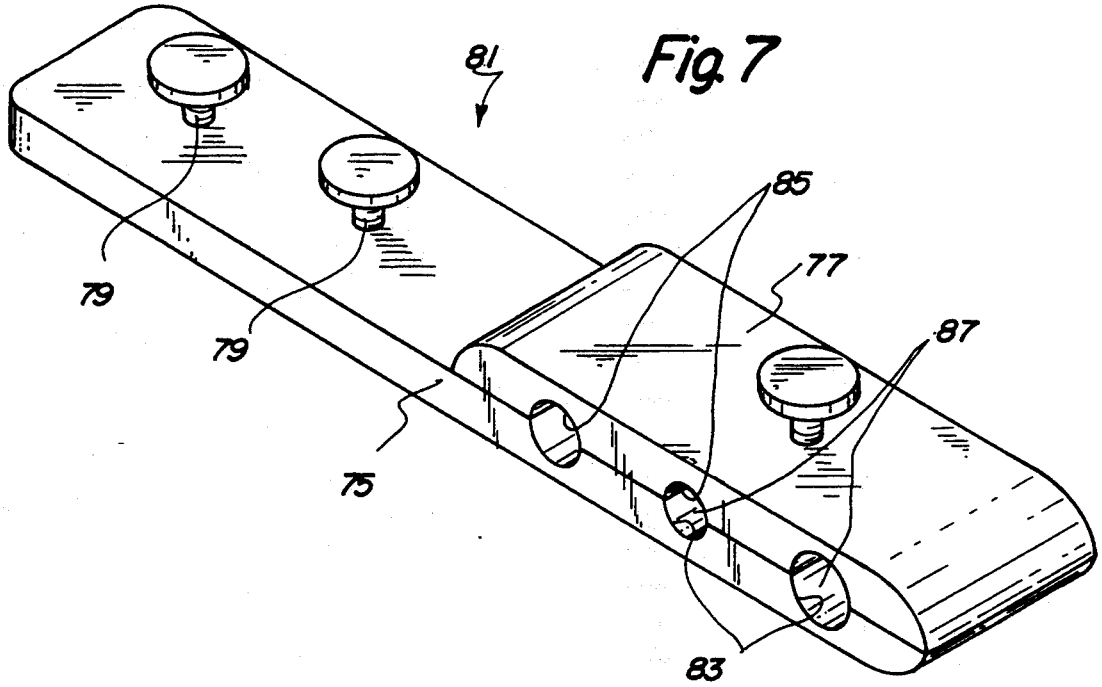
Fig. 7
Fig. 8
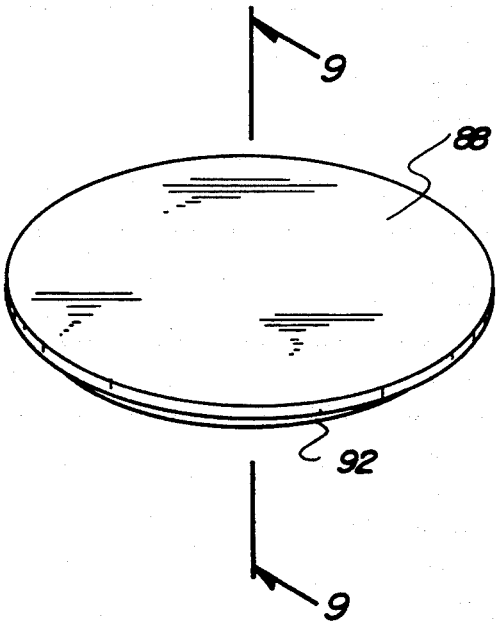

Fig. 9
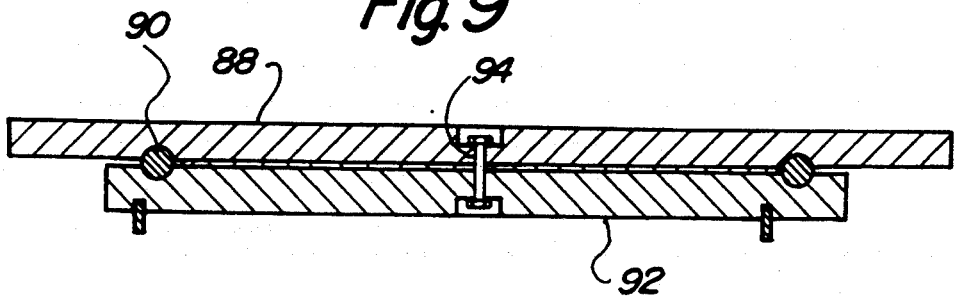
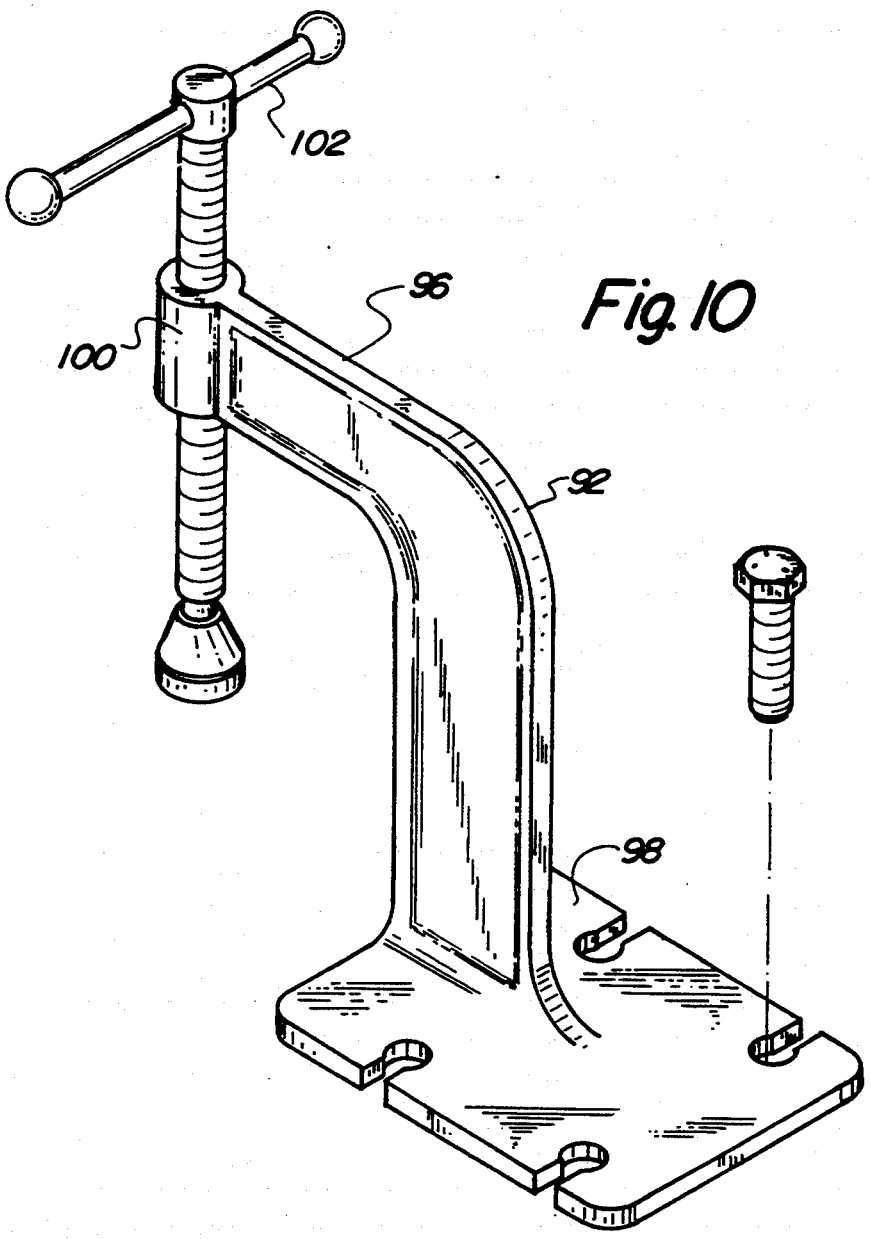
Fig. 10

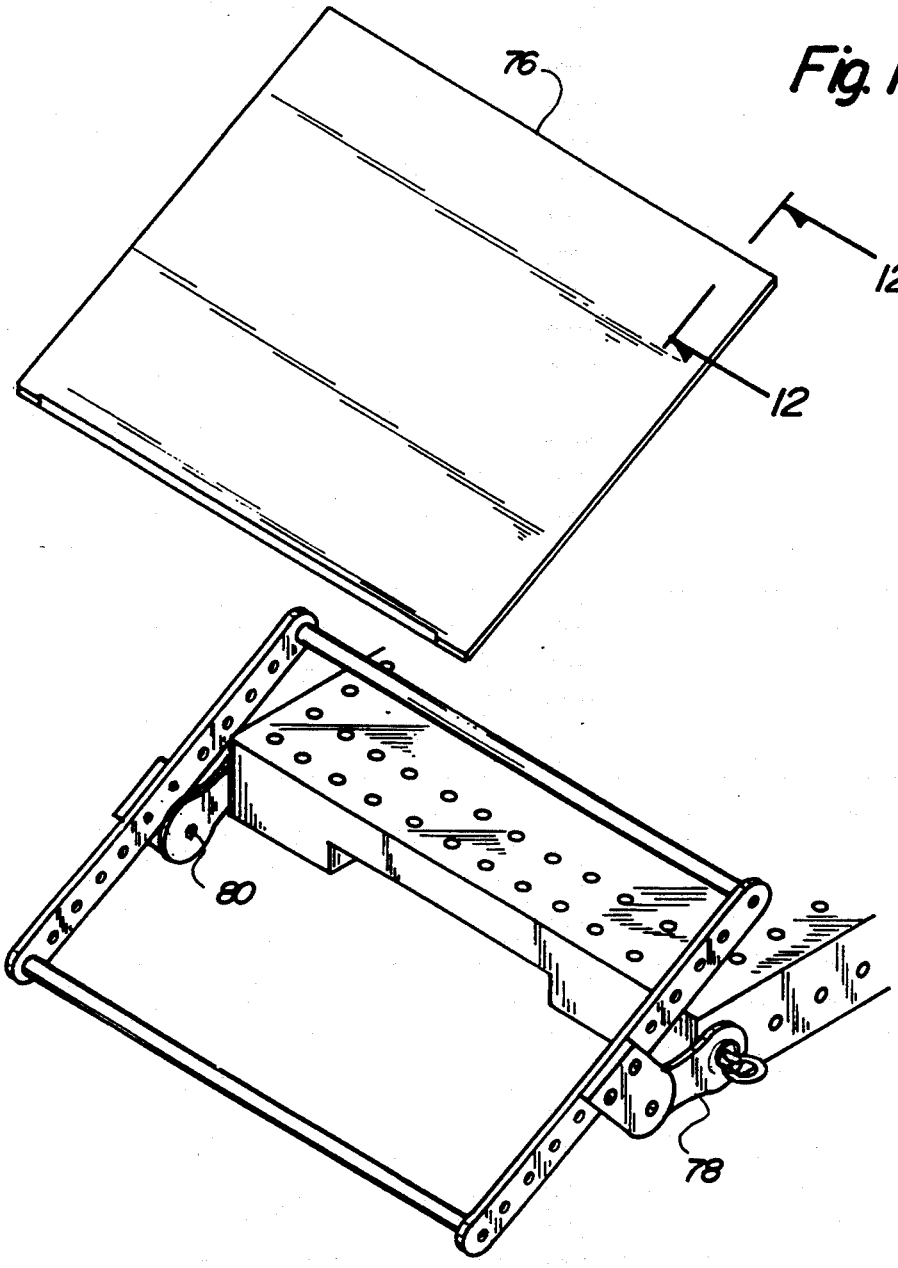
Fig. 11
Fig. 12
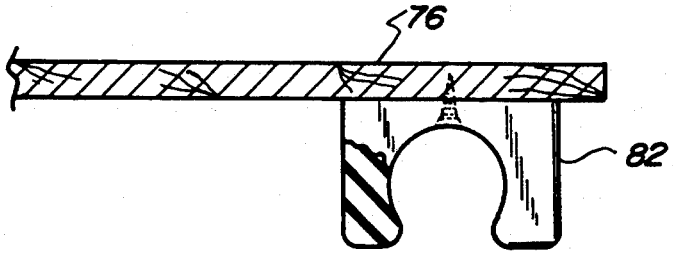

MULTI-FUNCTIONAL TABLE WITH ELEVATIONAL CAPABILITIES

BACKGROUND OF THE INVENTION

1. Field of the Invention

The present invention relates to a new and improved multi-functional table with elevational capabilities and, more particularly, pertains to varying the height of a table surface as a function of a particular application with components releasably attachable to the table surface.

2. Description of the Prior Art

The use of tables with adjustment capabilities of various designs and configurations is known in the prior art. More specifically, tables with adjustment capabilities of various designs and configurations heretofore devised and utilized for the purpose of adjusting tables by a wide variety of methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of tables with adjustment capabilities of various designs and configurations. By way of example, U.S. Pat. No. 4,315,466 to Boerigter discloses an adjustable table.

U.S. Pat. No. 4,475,727 to Goulter discloses a workbench with multiple-clamping arrangement.

U.S. Pat. No. 4,785,742 to Esslinger discloses a worktable with work surface and table mount.

U.S. Pat. No. 5,186,228 to Stafford discloses a workbench and mountable implements.

Lastly, U.S. Pat. No. 5,197,393 to Yeakle discloses a lift and tilt post table.

In this respect, the multi-functional table with elevational capabilities according to the present invention substantially departs from the conventional concepts and designs of the prior art, and in doing so provides an apparatus primarily developed for the purpose of varying the height of a table surface as a function of a particular application with components releasably attachable to the table surface.

Therefore, it can be appreciated that there exists a continuing need for a new and improved multi-functional table with elevational capabilities which can be used for varying the height of a table surface as a function of a particular application with components releasably attachable to the table surface. In this regard, the present invention substantially fulfills this need.

SUMMARY OF THE INVENTION

In view of the foregoing disadvantages inherent in the known types of tables with adjustment capabilities of various designs and configurations now present in the prior art, the present invention provides a new and improved multi-functional table with elevational capabilities. As such, the general purpose of the present invention, which will be described subsequently in greater detail, is to provide a new and improved multi-functional table with elevational capabilities and methods which have all the advantages of the prior art and none of the disadvantages.

To attain this, the present invention essentially comprises a new and improved multi-functional table with elevational capabilities comprising, in combination, a base in a generally rectangular configuration having an upper surface and a parallel lower surface and a periphery therearound; a table top in a generally rectangular configuration having an upper surface and a parallel lower surface; a central cylindrical support having an upper end secured to the lower surface of the table top and having a lower end secured to the upper surface of the base, the support being formed of a tubular member of an enlarged diameter at the lower end and a tubular member of a reduced diameter at the upper end for being slidably received within the lower component; a pump including a foot pedal secured to the base adjacent to the lower component whereby reciprocation of the foot pedal will act to supply air to the space between the upper and lower components to thereby raise the upper component and the working level of the table; additional telescoping legs secured between the lower surface of the table top and the upper surface of the base for providing greater stability to the table top with respect to the base, the upper and lower components of the additional legs being provided with bolts for the coupling therebetween at a particular elevational orientation; a plurality of apertures formed in the table top and supplemental components adapted to be secured to the table top; a hook with a threaded lower end and an inverted J-shaped upper end threadedly received in one of the holes of the table top with a T nut and extending upwardly therefrom; a clamp secured having a base and an upper extent with an adjustable support secured to the upper surface of the table top; a drafting board and an associated plate, the associated plate being secured to one edge of the table top and means to adjust the angle thereof; a support member with opposed plates and apertures therethrough adapted to be secured to the table top; a swivel having an upper circular component and a lower circular component with means depending from the lower circular component for coupling to the table top and a vertically extending axle therebetween with a bearing assembly around the axle; and a vise having a lower extent positionable with respect to the table, an upper extent positionable above the workpiece to be secured and an intermediate extent therebetween, the vise also including a threaded bolt rotatable to move a holding surface toward and away from an object to be supported on the table top.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multi-functional table with elevational capabilities which has all the advantages of the prior art tables with adjustment capabilities of various designs and configurations and none of the disadvantages.

It is another object of the present invention to provide a new and improved multi-functional table with elevational capabilities which may be easily and efficiently manufactured and marketed.

It is a further object of the present invention to provide a new and improved multi-functional table with elevational capabilities which is of a durable and reliable construction.

An even further object of the present invention is to provide a new and improved multi-functional table with elevational capabilities which is susceptible of a low cost of manufacture with regard to both materials and labor, and which accordingly is then susceptible of low prices of sale to the consuming public, thereby making such a multi-functional table with elevational capabilities economically available to the buying public.

Still yet another object of the present invention is to provide a new and improved multi-functional table with elevational capabilities which provides in the apparatuses and methods of the prior art some of the advantages thereof, while simultaneously overcoming some of the disadvantages normally associated therewith.

Even still another object of the present invention is to vary the height of a table surface as a function of a particular application with components releasably attachable to the table surface.

Lastly, it is an object of the present invention to provide a multi-functional table with elevational capabilities comprising a base in a generally rectangular configuration having an upper surface and a parallel lower surface; a table top in a generally rectangular configuration having an upper surface and a parallel lower surface; a central cylindrical support having an upper end secured to the lower surface of the table top and having a lower end secured to the upper surface of the base, the support being formed of a tubular member of an enlarged diameter at the lower end and a tubular member of a reduced diameter at the upper end for being slidably received within the lower component; a pump including a foot pedal secured to the base adjacent to the lower component whereby reciprocation of the foot pedal will act to supply air to the space between the upper and lower components to thereby raise the upper component and the working level of the table; and a plurality of apertures formed in the table top and supplemental components adapted to be secured to the table top.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a further attachment adapted to be secured to the base.

FIG. 8 is a perspective view of a swivel adapted to support the base of the present invention.

FIG. 9 is a cross-sectional view taken along line 9—9 of FIG. 8.

FIG. 10 is an exploded perspective view of yet another attachment adapted to be secured to the table top.

FIG. 11 is an exploded perspective view of a ramp adapted to be secured to one side of the table top as shown in the prior Figure.

FIG. 12 is a cross-sectional view of the coupling between the drafting board and foot board as shown in FIG. 11.

The same reference numerals refer to the same parts throughout the various Figures.

DESCRIPTION OF THE PREFERRED EMBODIMENT

Figure 2:
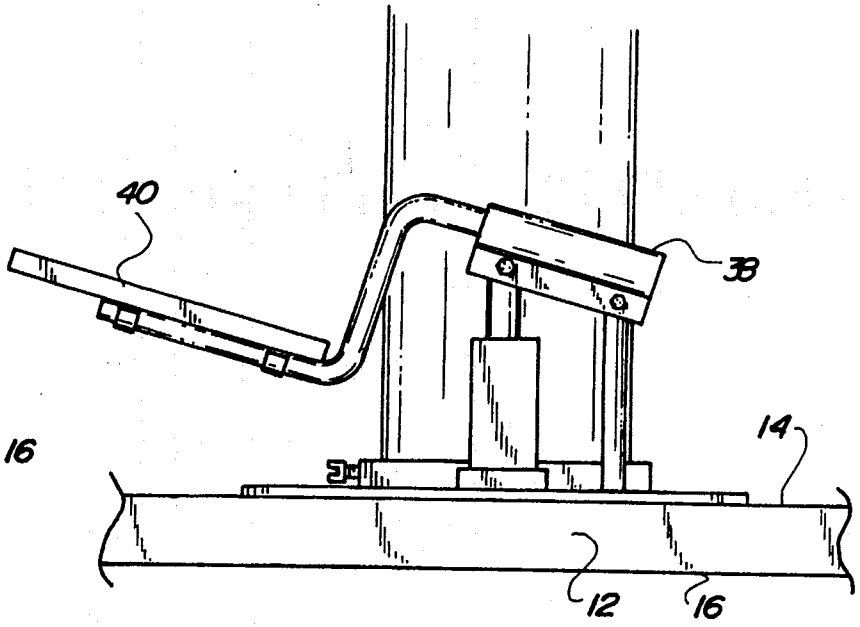
FIG. 2 is a side elevational view of the device shown in FIG. 1.
Figure 1:
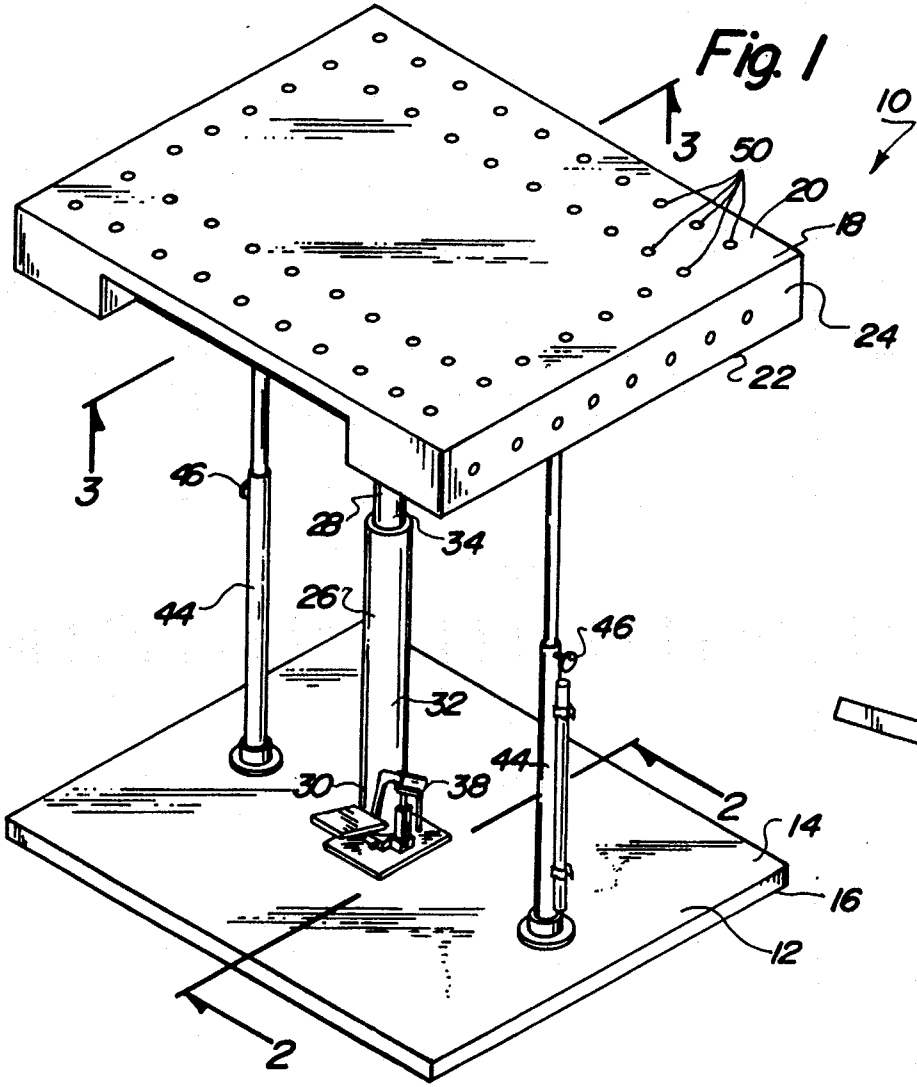
FIG. 1 is a perspective illustration of the preferred embodiment of the multi-functional table with elevational capabilities constructed in accordance with the principles of the present invention.
Figure 4:
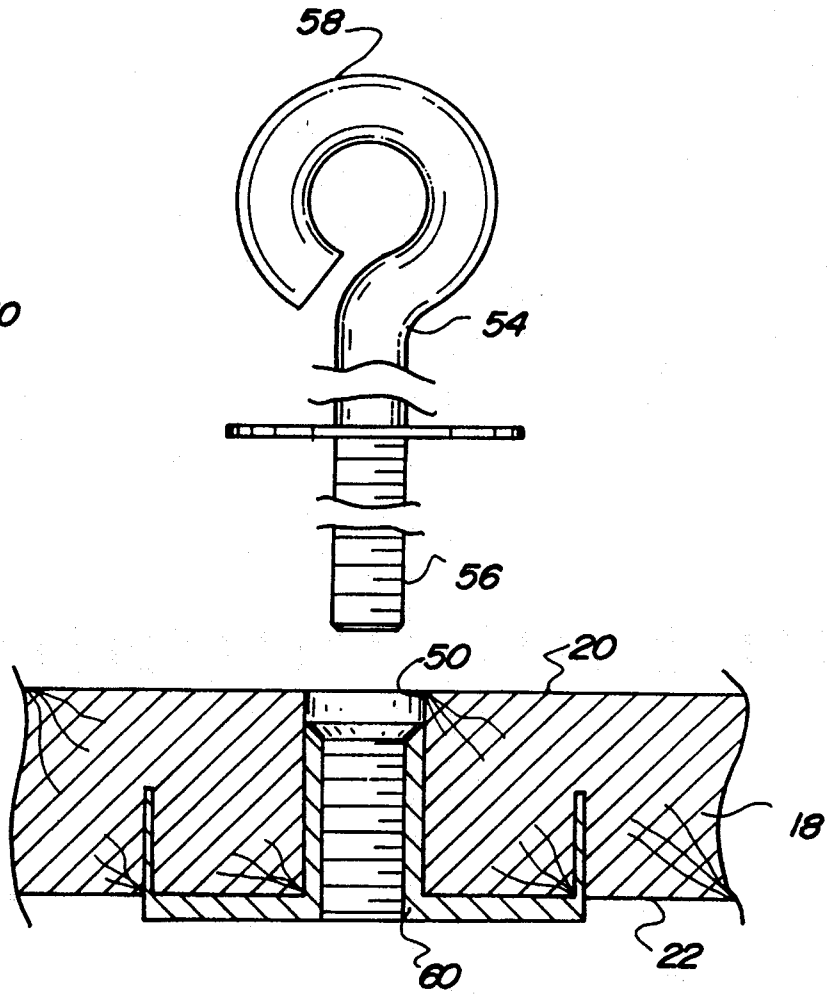
FIG. 4 is a cross-sectional view of the base with an optional accessory removably attached thereto.
Figure 3:
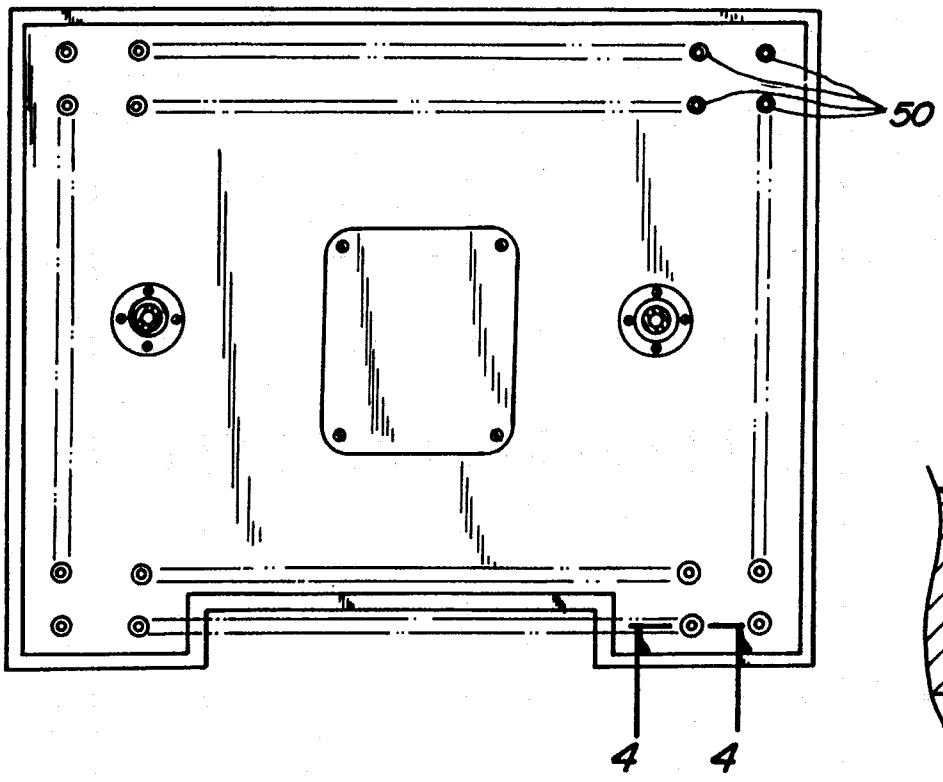
FIG. 3 is a top elevational view of the base shown in FIG. 1.
Figure 5:
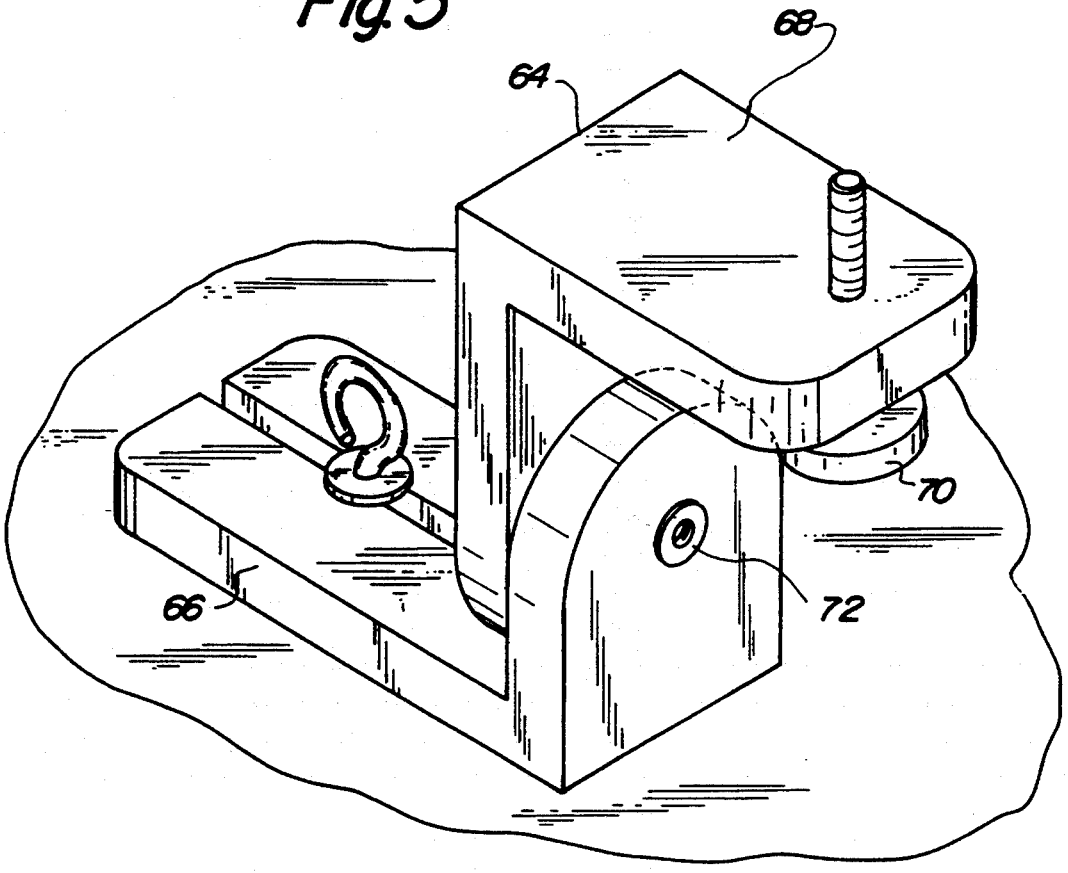
FIG. 5 is a perspective view of another removable component secured with respect to the table top.
Figure 6:
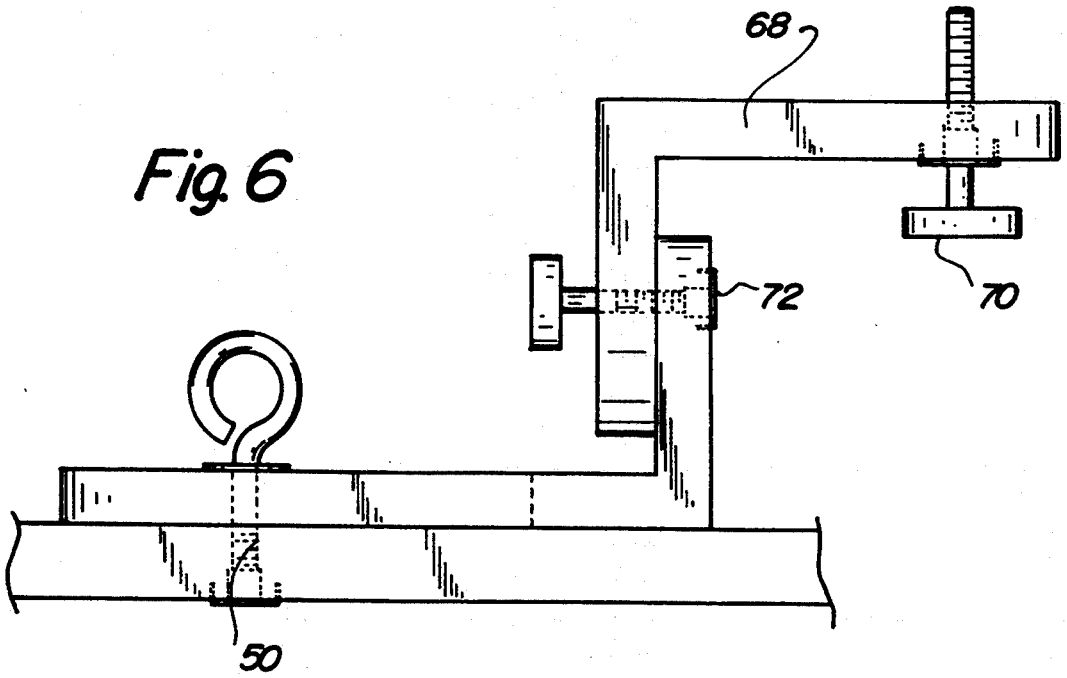
FIG. 6 is a side elevational view of the device shown in FIG. 5.

With reference now to the drawings, and in particular to FIG. 1 thereof, the preferred embodiment of the new and improved multi-functional table with elevational capabilities embodying the principles and concepts of the present invention and generally designated by the reference numeral 10 will be described.

The present invention, the new and improved multi-functional table with elevational capabilities, is a system 10 comprised of a plurality of components. Such components, in their broadest context, include a base, a table top, a cylindrical support, a pump, telescoping legs, apertures in the table top and a plurality of supplemental components positionable in contact with the table top. Each of the individual components is specifically configured and correlated one with respect to the other so as to attain the desired objectives.

The central component of the system 10 of the present invention is the base 12 formed in a generally rectangular configuration. It has an upper surface 14 and a parallel lower surface 16. The components of the table 10 of the present invention are positioned with respect thereto.

Located above the base is a table top 18. Such table top is in a generally rectangular configuration. It is fabricated of a rigid material such as steel. Plastic could readily be utilized for lighter applications. The table top has an upper surface 20 and a parallel lower surface 22 and a periphery 24 therearound.

Coupling between the base and table top is a central cylindrical support 26. Such support has an upper end 28 secured to the lower surface of the table top. It also has a lower end 30 secured to the upper surface of the base. The support is formed of a tubular member 32 having an enlarged diameter at the lower end. Also included therewith is a tubular member 34 of a reduced diameter. This tubular member is at the upper end of the cylindrical support for being slidably received within the lower component.

In association with the cylindrical support is a pump 38. The pump includes a foot pedal 40. Such pedal is secured to the base adjacent to the lower component. In this manner, reciprocation of the foot pedal will act to supply air to the space between the upper and lower components. This will function to thereby raise the upper component as well as the working level of the table top.

Additional telescoping legs 44 are also provided for stability between the table top and base. Such telescoping legs are secured between the lower surface of the table top and the upper surface of the base. Such legs function for providing greater stability to the table top with respect to the base. The upper and lower components of the additional legs are provided with bolts 46 positionable through apertures in the components. This is to couple the components with respect to each other to provide a particular desired elevational orientation for the table top. Located within the table top are a plurality of apertures 50. Such apertures are formed in the table top whereby supplemental components may be secured to the table top.

A hook 54 with a threaded lower end 56 is one of the supplemental components. In association therewith is an inverted J-shaped upper end 58. Such upper end is threadedly received in one of the holes of the table top through a T nut 60. The hook extends upwardly from the T nut.

Another optional component adapted to be used with the table top is a clamp 64. The clamp is secured to the table top through a base 66. The clamp has an upper extent 68 with adjustable supports 70, 72, one movable vertically, one movable horizontally. Such adjustable supports are adjustably secured with respect to the upper surface of the table top.

A further component for use with the table top is the drafting board 76 which has an associated plate 78. The associated plate is secured to one edge of the table top. Mechanisms 80 are provided to adjust the angle of the drafting board with respect to the table top through adjustable fingers 82.

Another optional component is a support member 81. Such member has a lower plate 75 and an upper plate 77. The lower plate has apertures 79 for coupling with the table top. The upper plate has recesses 83 which overlie mating recesses 85 in the lower plate thereby forming parallel apertures 87. A threaded bolt 89 extends through threaded apertures through the plates for coupling therebetween.

An alternate attachment is a swivel 88. The swivel is provided with an upper plate 90 and a lower plate 92. Each such plate is of a circular configuration and of a corresponding size. A pin 94 couples the upper and lower components of the swivel. A ball-bearing assembly is located therebetween to render the motion between the parts smooth and convenient for a user.

The last component adapted to be used with the base and table top is a vise 96. The vise has a lower extent 98 adapted to be removably secured through an aperture in the table top. An upper extent has a rotary nut 102 adapted to be moved toward or away from an object held therebeneath for securement thereof with respect to the table top.

Figure 14:
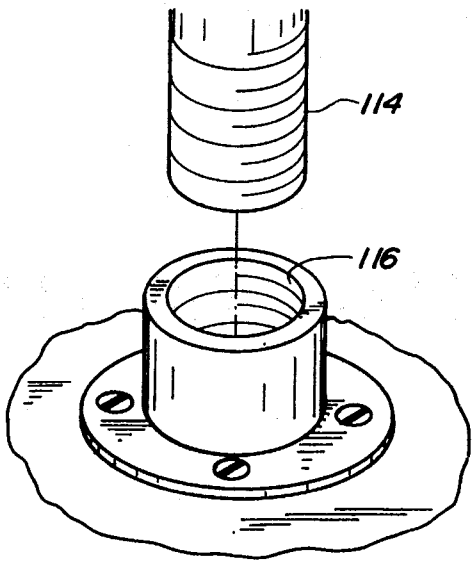
FIG. 14 is an exploded perspective view illustrating the coupling of one of the legs shown in FIG. 13.
Figure 13:
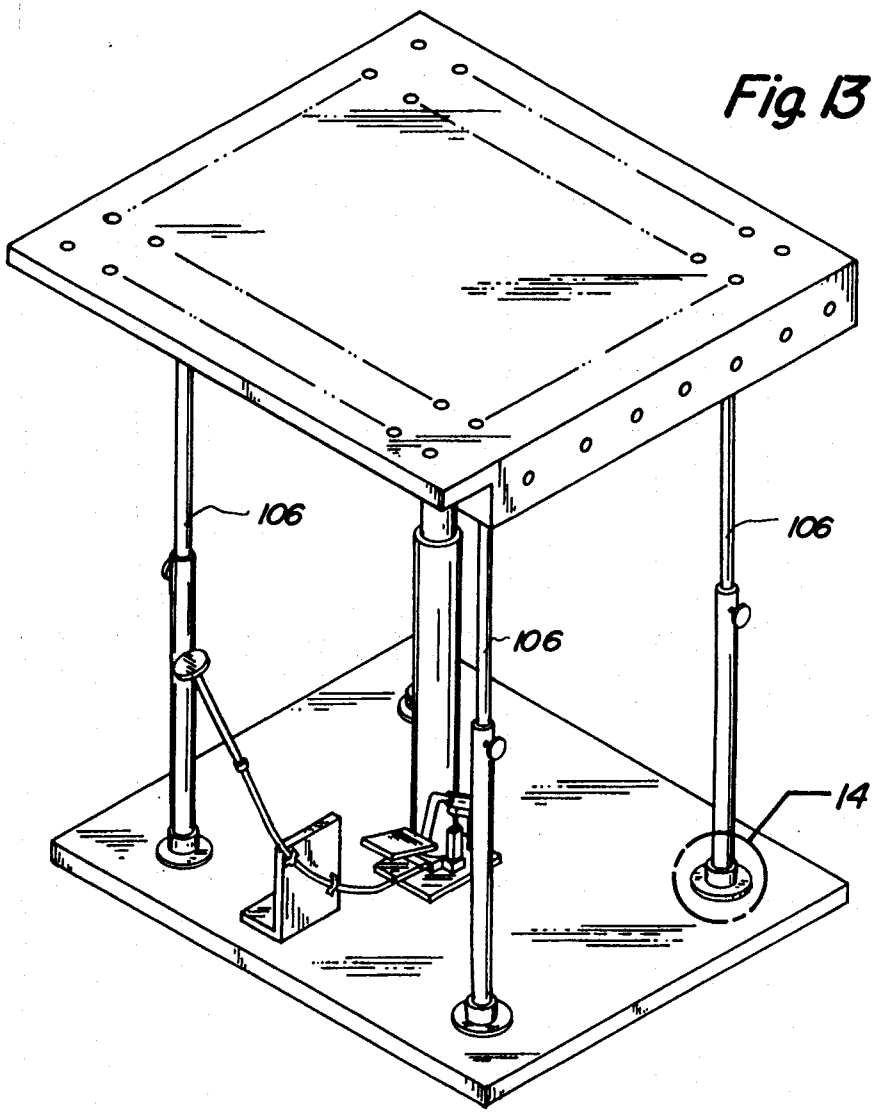
FIG. 13 is a perspective illustration of an alternate embodiment to the system of the prior Figures with alternate support structures for the table top.

An alternate embodiment of the invention is shown in FIGS. 13 and 14. In such embodiment, a greater number of telescoping legs 106 are provided, four in the preferred embodiment. These also include a telescoping component 110 as well as legs 114, 116 adapted to move with respect to each other.

The present invention comprises a platform which can be moved up and down hydraulically and locked in place to serve as a stand or bench with an adjustable height.

The platform is about 30 inches by 24 inches in size, is on top of a stand and a hydraulic jack which is operated by a foot pedal and a flexible cable to rotate the directional control valve. It can be moved from a minimum of 24 inches to a maximum of 44 inches in height. When set at the optimum height for the type of work to be performed, two or more stabilizing posts are set under it and locked to make it more rigid. The posts telescope together and are equipped with simple locking screws which also help to prevent vibrations that are undesirable for critical work. Across the entire platform are through tapped holes, located on three inch centers, which are used for many purposes.

One of the most important features of this table is its versatility. All types of attachments could be added so it can even serve as a drafting table, workbench, repair stand, and the like. Adding items like vises is simpler because of the tapped holes. By attaching a ramp, even a lawn mower can be pushed up on the platform.

The unit could also be made in other sizes, utilizing a larger or smaller jack, if necessary. Tops of various materials, and which can be tilted, may be optional or standard.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved multi-functional table with elevational capabilities comprising, in combination:

a base in a generally rectangular configuration having an upper surface and a parallel lower surface and a periphery therearound;

a table top in a generally rectangular configuration having an upper surface and a parallel lower surface and with laterally depending sides;

a central cylindrical support having an upper end secured to the lower surface of the table top and having a lower end secured to the upper surface of the base, the support being formed of a tubular member of an enlarged diameter at the lower end and a tubular member of a reduced diameter at the upper end for being slidably received within the lower end;

a pump including a foot pedal secured to the base adjacent to the lower end whereby reciprocation of the foot pedal will act to supply air to a space between the upper and lower ends to thereby raise the upper end the table top to a desired working level;

additional telescoping legs secured between the lower surface of the table top and the upper surface of the base for providing greater stability to the table top with respect to the base, the upper and lower ends of the additional legs being provided with bolts for the a coupling therebetween at a particular elevational orientation;

a plurality of apertures formed in the table top and sides;

supplemental components adapted to be secured to the table top, such components including:

a hook with a threaded lower end and an inverted J-shaped upper end threadedly received in one of the apertures of the table top with a T nut and extending upwardly therefrom;

a clamp secured having a base and an upper extent with an adjustable support secured to the upper surface of the table top;

a drafting board and an associated plate, the associated plate being secured to one edge of the table top and means to adjust the plate a desired angle;

a support member with opposed plates and apertures therethrough adapted to be secured to the table top;

a swivel having an upper circular component and a lower circular component with means depending from the lower circular component for coupling to the table top and a vertically extending axle therebetween with a bearing assembly around the axle; and a vise having a lower extent positionable with respect to the table, top an upper extent positionable above the workpiece to be secured and an intermediate extent therebetween, the vise also including a threaded bolt rotatable to move a holding surface toward and away from an object to be supported on the table top.

2. A multi-functional table with elevational capabilities comprising:

a base in a generally rectangular configuration having an upper surface and a parallel lower surface;

a table top in a generally rectangular configuration having an upper surface and a parallel lower surface;

a central cylindrical support having an upper end secured to the lower surface of the table top and having a lower end secured to the upper surface of the base, the support being formed of a tubular member of an enlarged diameter at the lower end and a tubular member of a reduced diameter at the upper end for being slidably received within the lower component;

a pump including a foot pedal secured to the base adjacent to the lower end whereby reciprocation of the foot pedal will act to supply air to a space between the upper and lower ends to thereby raise the upper end and the working level of the table top; and a plurality of apertures formed in the table top and supplemental components adapted to be secured to the table top.

3. The apparatus as set forth in claim 2 and further including:

a hook with a threaded lower end and an inverted J-shaped upper end threadedly received in one of the apertures of the table top with a T nut and extending upwardly therefrom.

4. The apparatus as set forth in claim 2 and further including:

a clamp having a base and an upper extent with an adjustable support secured to the upper surface of the table top.

5. The apparatus as set forth in claim 2 and further including:

a plurality of telescoping legs located at between of the corners between the base and the table top.

6. The apparatus as set forth in claim 2 and further including:

a support member with opposed plates and apertures therethrough adapted to be secured to the table top.

7. The apparatus as set forth in claim 2 and further including:

a swivel with an upper plate and a lower plate, a central pivot pin and a bearing assembly therebetween adapted to be coupled to the table top.

8. The apparatus as set forth in claim 2 and further including:

a vise having a base adapted to be coupled to the table top with an upper member with a threaded rod therethrough.

9. The apparatus as set forth in claim 2 and further including:

a drafting board and an associated plate, the associated plate being secured to one edge of the table top and means to adjust the plate to a desired angle.

* * * * *